US008434227B2

(12) United States Patent
Eisele

(10) Patent No.: US 8,434,227 B2
(45) Date of Patent: May 7, 2013

(54) METHOD OF FORMING HEAT EXCHANGER TUBES

(75) Inventor: Siegfried Eisele, Schönaich (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 13/206,080

(22) Filed: Aug. 9, 2011

(65) Prior Publication Data

US 2012/0031602 A1 Feb. 9, 2012

Related U.S. Application Data

(63) Continuation-in-part of application No. 12/140,524, filed on Jun. 17, 2008, now abandoned, and a continuation-in-part of application No. 12/063,744, filed as application No. PCT/US2007/060790 on Jan. 19, 2007.

(30) Foreign Application Priority Data

| | | |
|---|---|---|
| Jan. 19, 2006 | (DE) | 10 2006 002 627 |
| Jan. 20, 2006 | (DE) | 10 2006 002 789 |
| Jan. 21, 2006 | (DE) | 10 2006 002 932 |
| Feb. 14, 2006 | (DE) | 10 2006 006 670 |
| Apr. 8, 2006 | (DE) | 10 2006 016 711 |
| Jun. 27, 2006 | (DE) | 10 2006 029 378 |
| Jul. 13, 2006 | (DE) | 10 2006 032 406 |
| Jul. 20, 2006 | (DE) | 10 2006 033 568 |
| Jul. 29, 2006 | (DE) | 10 2006 035 210 |
| Sep. 2, 2006 | (DE) | 10 2006 041 270 |
| Sep. 9, 2006 | (DE) | 10 2006 042 427 |
| Jun. 21, 2007 | (DE) | 10 2007 028 710 |

(51) Int. Cl.
*B21D 53/06* (2006.01)
*B23P 15/26* (2006.01)

(52) U.S. Cl.
USPC ..... 29/890.049

(58) Field of Classification Search ..... 29/890.049
See application file for complete search history.

(56) References Cited

U.S. PATENT DOCUMENTS

| | | | |
|---|---|---|---|
| 1,242,652 | A | 9/1917 | Capell |
| 1,599,395 | A | 9/1926 | Hards |

(Continued)

FOREIGN PATENT DOCUMENTS

| | | |
|---|---|---|
| DE | 273441 | 7/1912 |
| DE | 401893 | 9/1924 |

(Continued)

OTHER PUBLICATIONS

Non-Final Office Action from the United States Patent and Trademark Office for U.S. Appl. No. 12/140,524 dated Mar. 9, 2011 (10 pages).

(Continued)

*Primary Examiner* — David Bryant
*Assistant Examiner* — Moshe Wilensky
(74) *Attorney, Agent, or Firm* — Michael Best & Friedrich LLP

(57) ABSTRACT

A method for manufacturing tubes, in particular for heat exchangers, composed of endless ribbons on a roller mill, wherein the tubes are composed of at least two ribbons which are subjected to a shaping process on the roller mill, wherein perforations or predetermined break points are introduced into the ribbons at predetermined locations, wherein a step of making the perforations in the ribbons is carried out, after which the ribbons are combined to form the tube and after which individual tubes are separated off at the predetermined locations. The formation of the perforations or the predetermined break points in at least one of the two ribbons is performed within or at the end of the shaping process of the corresponding ribbon so that some of the pairs of rollers do not require a drive.

10 Claims, 6 Drawing Sheets

U.S. PATENT DOCUMENTS

| | | | |
|---|---|---|---|
| 2,222,842 | A | 11/1940 | Humphrey |
| 2,252,210 | A | 8/1941 | Seemiller |
| 2,373,218 | A | 4/1945 | Arnold |
| 2,444,463 | A | 7/1948 | Nordquist |
| 2,757,628 | A | 8/1956 | Johnston |
| 2,912,749 | A | 11/1959 | Bauernfeind et al. |
| 3,021,804 | A | 2/1962 | Simpelaar |
| 3,053,511 | A | 9/1962 | Godfrey |
| 3,229,760 | A | 1/1966 | Hurter et al. |
| 3,687,193 | A | 8/1972 | Wright |
| 3,734,135 | A | 5/1973 | Mosier |
| 3,957,386 | A | 5/1976 | Lupke |
| 4,197,625 | A | 4/1980 | Jahoda |
| 4,215,744 | A | 8/1980 | Bowles |
| 4,470,452 | A | 9/1984 | Rhodes |
| 4,501,321 | A | 2/1985 | Real et al. |
| 4,570,700 | A | 2/1986 | Ohara et al. |
| 4,805,693 | A | 2/1989 | Flessate |
| 4,901,908 | A | 2/1990 | Negura et al. |
| 4,949,543 | A | 8/1990 | Cotton et al. |
| 5,036,909 | A | 8/1991 | Whitehead et al. |
| 5,058,266 | A | 10/1991 | Knoll |
| 5,179,770 | A | 1/1993 | Block et al. |
| 5,185,925 | A | 2/1993 | Ryan et al. |
| 5,186,250 | A | 2/1993 | Ouchi et al. |
| 5,201,117 | A | 4/1993 | Wright |
| 5,271,754 | A | 12/1993 | Bauerecker et al. |
| 5,351,750 | A | 10/1994 | Garcia |
| 5,386,629 | A | 2/1995 | Ouchi et al. |
| 5,441,106 | A | 8/1995 | Yukitake |
| 5,456,006 | A | 10/1995 | Study |
| 5,457,885 | A | 10/1995 | Ohashi et al. |
| 5,692,300 | A | 12/1997 | Conn et al. |
| 5,697,433 | A | 12/1997 | Kato |
| 5,799,727 | A | 9/1998 | Liu |
| 6,119,341 | A | 9/2000 | Kato et al. |
| 6,167,601 | B1 | 1/2001 | Gollhofer et al. |
| 6,192,977 | B1 | 2/2001 | Dey et al. |
| 6,209,202 | B1 | 4/2001 | Rhodes et al. |
| 6,261,706 | B1 | 7/2001 | Fukuda et al. |
| 6,308,775 | B1 | 10/2001 | Naumann |
| 6,425,261 | B2 | 7/2002 | Burk et al. |
| 6,467,170 | B2 | 10/2002 | Kato et al. |
| 6,470,570 | B2 | 10/2002 | Prater et al. |
| 6,475,301 | B1 | 11/2002 | Grab et al. |
| 6,502,305 | B2 | 1/2003 | Martins et al. |
| 6,513,586 | B1 | 2/2003 | Haussmann |
| 6,527,045 | B1 | 3/2003 | Osakabe et al. |
| 6,537,388 | B1 | 3/2003 | Wynns et al. |
| 6,546,774 | B2 | 4/2003 | Granetzke |
| 6,640,886 | B2 | 11/2003 | Lamich |
| 6,640,887 | B2 | 11/2003 | Abell et al. |
| 6,666,265 | B1 | 12/2003 | Kato et al. |
| 6,681,597 | B1 | 1/2004 | Yin et al. |
| 6,988,539 | B2 | 1/2006 | Kato et al. |
| 7,107,680 | B2 | 9/2006 | Ueda |
| 7,117,936 | B2 | 10/2006 | Ohata et al. |
| 7,135,239 | B2 | 11/2006 | Rajagopalan |
| 7,152,671 | B2 | 12/2006 | Shibagaki et al. |
| 7,204,302 | B2 | 4/2007 | Shibagaki et al. |
| 7,461,689 | B2 | 12/2008 | Merklein et al. |
| 7,487,589 | B2 | 2/2009 | Smith et al. |
| 7,665,512 | B2 | 2/2010 | Brost et al. |
| 2003/0024694 | A1 | 2/2003 | Lamich |
| 2004/0035910 | A1 | 2/2004 | Dokus et al. |
| 2004/0108305 | A1 | 6/2004 | Harnisch et al. |
| 2004/0194943 | A1 | 10/2004 | Yamauchi |
| 2004/0206481 | A1 | 10/2004 | Inaba |
| 2004/0206482 | A1 | 10/2004 | Bang |
| 2005/0006082 | A1 | 1/2005 | Brost et al. |
| 2005/0077033 | A1 | 4/2005 | Schmalzried |
| 2005/0092476 | A1 | 5/2005 | Hu et al. |
| 2005/0133210 | A1 | 6/2005 | Inagaki et al. |
| 2005/0247444 | A1 | 11/2005 | Ohata et al. |
| 2006/0086491 | A1 | 4/2006 | Ueda |
| 2006/0230617 | A1 | 10/2006 | Kent et al. |
| 2006/0243429 | A1 | 11/2006 | Chu et al. |
| 2006/0265874 | A1 | 11/2006 | Hashimoto et al. |
| 2006/0283585 | A1 | 12/2006 | Smith et al. |
| 2007/0095514 | A1 | 5/2007 | Inoue et al. |
| 2008/0313906 | A1 | 12/2008 | Eisele |
| 2009/0014164 | A1 | 1/2009 | Zobel et al. |
| 2009/0014165 | A1 | 1/2009 | Zobel et al. |
| 2009/0019689 | A1 | 1/2009 | Zobel et al. |
| 2009/0019694 | A1 | 1/2009 | Zobel et al. |
| 2009/0019695 | A1 | 1/2009 | Zobel et al. |
| 2009/0019696 | A1 | 1/2009 | Zobel et al. |
| 2009/0020277 | A1 | 1/2009 | Zobel et al. |
| 2009/0020278 | A1 | 1/2009 | Zobel et al. |
| 2009/0056927 | A1 | 3/2009 | Zobel et al. |
| 2009/0218085 | A1 | 9/2009 | Rogers et al. |
| 2009/0260794 | A1 | 10/2009 | Minami et al. |
| 2010/0243225 | A1 | 9/2010 | Zobel et al. |

FOREIGN PATENT DOCUMENTS

| | | |
|---|---|---|
| DE | 934644 | 11/1955 |
| DE | 935487 | 11/1955 |
| DE | 2113581 | 12/1972 |
| DE | 3809944 | 10/1989 |
| DE | 4031577 | 4/1992 |
| DE | 4340378 | 6/1994 |
| DE | 29614186 | 12/1997 |
| DE | 19641144 | 4/1998 |
| DE | 69316485 | 5/1998 |
| DE | 19753724 | 6/1999 |
| DE | 10137334 | 2/2003 |
| DE | 10200586 | 7/2003 |
| DE | 69821372 | 10/2004 |
| DE | 102004057407 | 8/2005 |
| DE | 102006029378 | 1/2008 |
| DE | 102006035210 | 1/2008 |
| DE | 102006033568 | 2/2008 |
| DE | 102006059609 | 6/2008 |
| EP | 0179646 | 4/1986 |
| EP | 0765701 | 4/1997 |
| EP | 0859209 | 8/1998 |
| EP | 0907062 | 4/1999 |
| EP | 1074807 | 2/2001 |
| EP | 1306156 | 5/2003 |
| EP | 1362649 | 11/2003 |
| EP | 1640684 | 3/2006 |
| EP | 1684041 | 7/2006 |
| EP | 1702710 | 9/2006 |
| FR | 2690233 | 10/1993 |
| FR | 2811746 | 1/2002 |
| GB | 444964 | 3/1936 |
| GB | 683161 | 11/1952 |
| GB | 2203677 | 10/1988 |
| GB | 2354960 | 4/2001 |
| GB | 2426727 | 12/2006 |
| JP | 57105690 | 7/1982 |
| JP | 58000094 | 1/1983 |
| JP | 60247426 | 12/1985 |
| JP | 7019779 | 1/1995 |
| JP | 09011021 | 1/1997 |
| JP | 10160375 | 6/1998 |
| JP | 2001050677 | 2/2001 |
| JP | 2002350083 | 12/2002 |
| JP | 2004092940 | 3/2004 |
| JP | 2005214511 | 8/2005 |
| JP | 2006064345 | 3/2006 |
| RU | 2032878 | 4/1995 |
| SU | 340209 | 1/1972 |
| SU | 616521 | 7/1978 |
| WO | 03/060412 | 7/2003 |
| WO | 2004/080640 | 9/2004 |
| WO | 2004/085948 | 10/2004 |
| WO | 2005/033606 | 4/2005 |
| WO | 2006/116857 | 11/2006 |
| WO | 2007/009588 | 1/2007 |
| WO | 2007084984 | 7/2007 |
| WO | 2008/011115 | 1/2008 |

OTHER PUBLICATIONS

DE 102010022713.7 German Search Report dated Apr. 11, 2011 (English Translation—5 pages).

DE 102006033568.6 German Search Report dated May 4, 2007 (4 pages).

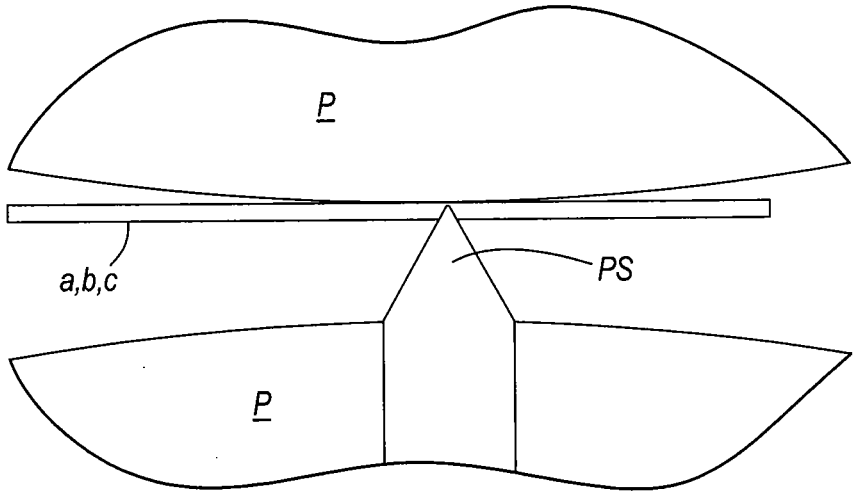
FIG. 3a
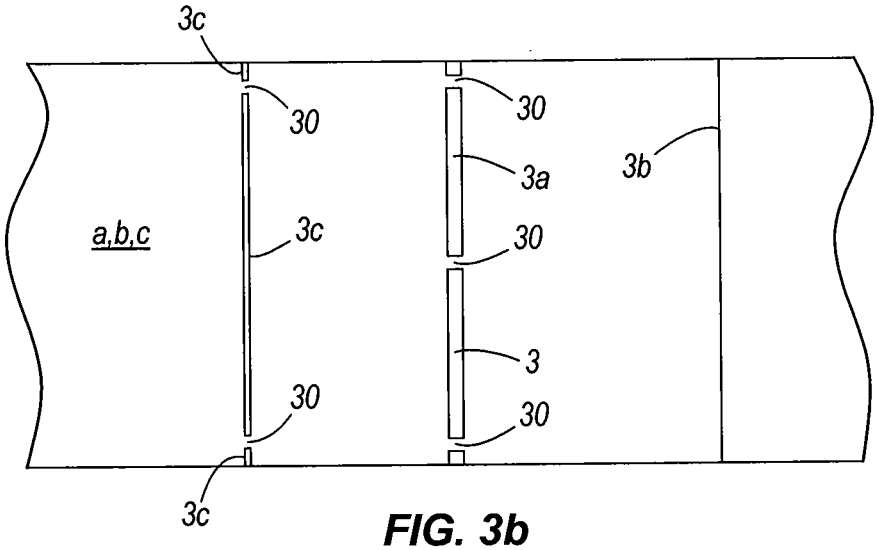
FIG. 3b
FIG. 3c
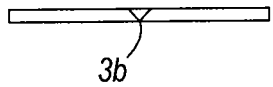

METHOD OF FORMING HEAT EXCHANGER TUBES

CROSS-REFERENCE TO RELATED APPLICATIONS

This application is a continuation-in-part of co-pending U.S. patent application Ser. No. 12/140,524, filed Jun. 17, 2008, which claims priority to German Patent Application No. DE 10 2007 028710.2, filed Jun. 21, 2007, the entire contents of both of which are incorporated herein by reference. This application is also a continuation-in-part of co-pending U.S. patent application Ser. No. 12/063,744, filed Jun. 6, 2008, which is a national stage filing under 35 U.S.C. 371 of International Application No. PCT/US2007/060790, filed 19 Jan. 2007, and claims priority to the following German patent applications: German Patent Application No. DE 10 2006 002 627.6, filed Jan. 19, 2006, and to German Patent Application No. DE 10 2006 002 789.2, filed on Jan. 20, 2006, and to German Patent Application No. DE 10 2006 002 932.1, filed on Jan. 21, 2006, and to German Patent Application No. DE 10 2006 006 670.7, filed Feb. 14, 2006, and to German Patent Application No. DE 10 2006 016 711.2, filed Apr. 8, 2006, and to German Patent Application No. DE 10 2006 029 378.9, filed Jun. 27, 2006, and to German Patent Application No. DE 10 2006 032 406.4, filed Jul. 13, 2006, and to German Patent Application No. DE 10 2006 033 568.6, filed Jul. 20, 2006, and to German Patent Application No. DE 10 2006 035 210.6, filed Jul. 29, 2006, and to German Patent Application No. DE 10 2006 041 270.2, filed Sep. 2, 2006, and to German Patent Application No. DE 10 2006 042 427.1, filed Sep. 9, 2006. The entire contents of all the foregoing applications are incorporated herein by reference.

FIELD OF THE INVENTION

The present invention relates to a method of forming tubes, and more particularly to a method of forming heat exchanger tubes on a roller mill.

SUMMARY

In some embodiments, the present invention provides a method for manufacturing tubes, in particular for heat exchangers, composed of endless ribbon material on a roller mill. Tubes can be formed from at least two parts or ribbon strips which are subjected to a shaping process on a roller mill. Perforations or predetermined break points are introduced into the ribbon material at predetermined locations. A step of making the perforations in the parts or ribbon strips is carried out, after which the parts are combined to form the tube and after which individual tubes are separated off from the tube at predetermined locations.

Published German Patent Application Nos. DE 10 2006 033 568.6 and DE 10 2006 059 609.9 disclose prior art systems. It has become apparent that the formation of perforations or of predetermined break points in the not yet shaped sheet metal strips that was envisaged in the earlier applications can lead to tearing off of the ribbon strips in the course of their shaping unless all, or at least a large number of, the shaping rollers of the roller mill have a drive. The result of such a system is that the sheet metal strips have to be pulled through non-driven shaping rollers, during which process the aforementioned tearing off can occur. However, equipping all the shaping rollers with a drive entails a relatively high level of investment in the roller mill. It is also possible for excessive and undesirable stretching to occur in the webs which are associated with the perforations.

DE-AS 10 25 821 describes the manufacture of flat tubes from just one ribbon strip. A central part of the ribbon strip is provided with a corrugation and the two edge parts are positioned as wall parts of the flat tube around the central, corrugated part. In order to be able to separate off individual flat tubes from the endless flat tube, slots and webs are made in the ribbon strips at intervals corresponding to the desired tube lengths. After this, the shaping of the flat tube is continued by the already mentioned folding over of the lateral edge parts in order to close the flat tube and finally separate it off at the perforation.

Compared to the method mentioned above, the method of the present invention has the advantage that the method steps of making the perforations from two or even three sheet metal strips correspond and combine the sheet metal strips to form the tube which steps are extremely difficult at least on first sight, are not required because the known flat tube is, as mentioned, manufactured from only a single sheet metal strip. However, it is disadvantageous that with the known method it is not possible to provide heat exchangers with extremely thin wall thicknesses of the tubes or with a significant improvement in terms of performance per unit of weight because the wall thickness of the tube usually has to be the same as the wall thickness of the corrugated central part.

One independent object of the invention is to develop a manufacturing method for tubes presented at the beginning in such a way that, inter alia, the investment in the roller mill can be reduced. There is provision for the formation of the perforations or of the predetermined break points in at least one of the two ribbon strips or the two parts to be performed within the shaping process or subsequent to the shaping process of the corresponding ribbon strip. In such cases in which the perforations are provided within the shaping process it is advantageous to construct the perforations just before the end of the shaping process. It has been found that with this measure the undesired tearing of the ribbon strip can be prevented. It is therefore not necessary to provide all the shaping rollers with a drive, for which reason it has been possible to reduce the investment for the roller mill. Furthermore, it has been found that the stretching of the ribbon strip at the webs of the perforations occurs to a significantly smaller degree or is even negligible, as a result of which the perforations in the preferably three ribbon strips can be made to correspond with a higher degree of precision.

The present invention also provides a roller mill with which the manufacturing method is carried out. The roller mill can include a perforation station arranged inside or, viewed in the running direction of the ribbon strip, downstream of the shaping station. The flat tubes which run from the roller mill are combined with and soldered to corrugation fins to form a heat exchanger system. In this context, all the flat tubes are permanently connected to one another and also to the air-side corrugation fins.

The perforations can either be slots with webs or else linear ribbon thinning lines which constitute predetermined break points, preferably in a straight line.

A third part, which constitutes a later internal insert of the tubes, is preferably provided.

The perforation or the manufacture of the predetermined break lines is preferably carried out by means of rollers. In some embodiments, there is at least one pair of rollers in this context.

Other aspects of the invention will become apparent by consideration of the detailed description and accompanying drawings.

BRIEF DESCRIPTION OF THE DRAWINGS

FIGS. 3*a, b* and *c* show perforations or optionally predetermined break points in sheet metal ribbons.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

In the exemplary embodiment shown, tubes 1 which are composed of three parts a, b, c are manufactured. The parts a and b are respectively the upper and lower wall parts of the flat tube, and the part c is a corrugated internal insert of the flat tube. A cross section of the finished, preferred tube can be seen in FIG. 7. An embodiment of the preferred flat tube 1 which is slightly modified with respect to the corrugated internal insert c can be found in FIG. 8, which shows merely one of the edges of the flat tube 1. The parts a and b are identical but laterally inverted with respect to one another, in which case one of the relatively large edge arcs of the parts a, b engages around the other relatively small edge arc of the respective other part. The part c is also shaped at its two longitudinal edges and they advantageously reinforce the narrow sides 12 of the tube 1 by virtue of the fact that the longitudinal edges come to rest there. The preferred thickness of the parts is in the range of, for example, 0.03-0.09 mm for the internal insert c and of 0.03-0.15 mm or somewhat more for the wall parts a, b. The dimensions of the tubes can vary from a clear width d of approximately 1.0 mm or less and up to 10 mm or more. The tube width D can be selected over wide ranges by virtue of the fact that a correspondingly wide sheet metal ribbon is used.

Figure 1:
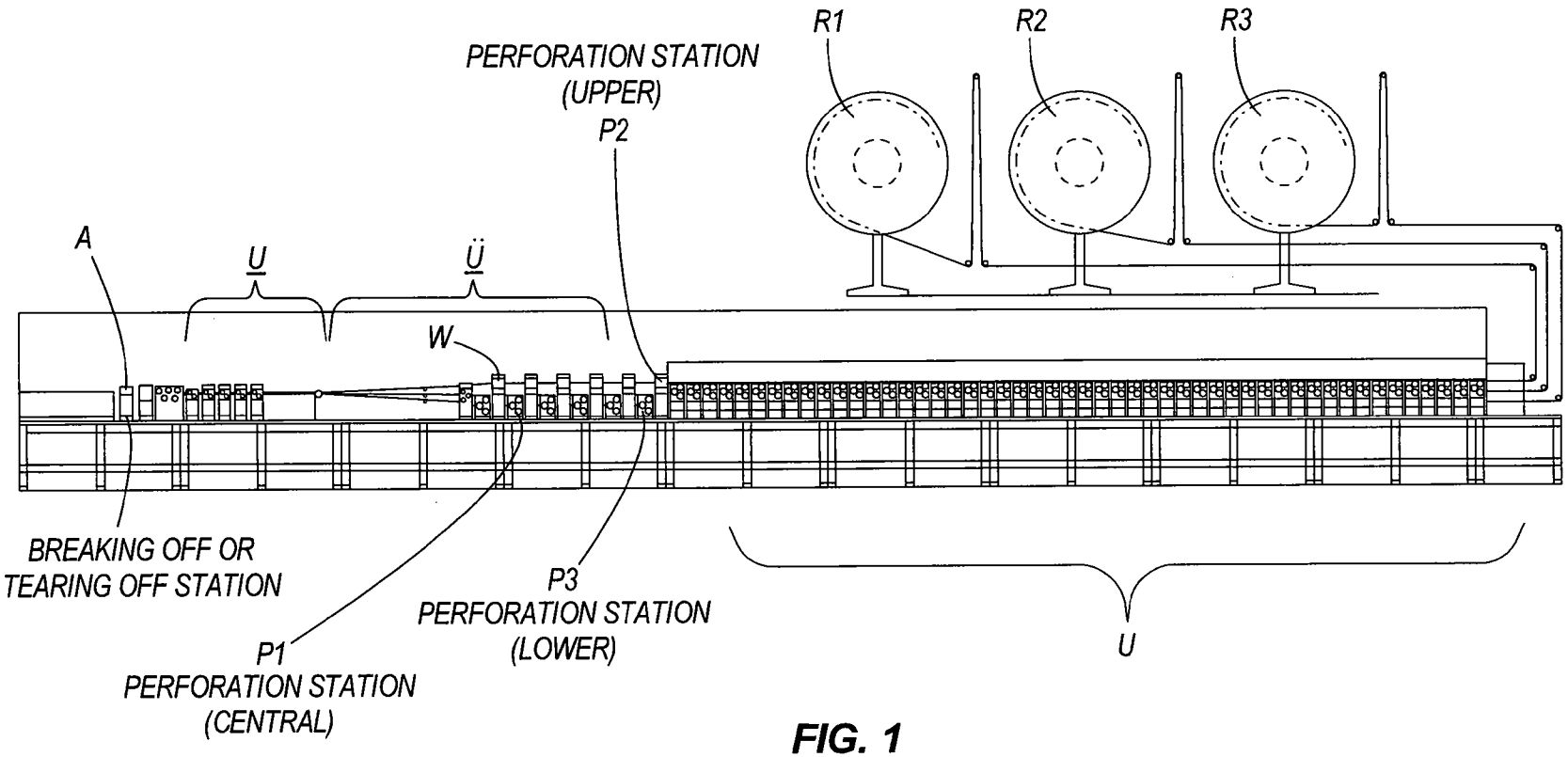
FIG. 1 is a schematic illustration of a roller mill for manufacturing tubes according to some embodiments of the present invention.
Figure 4:
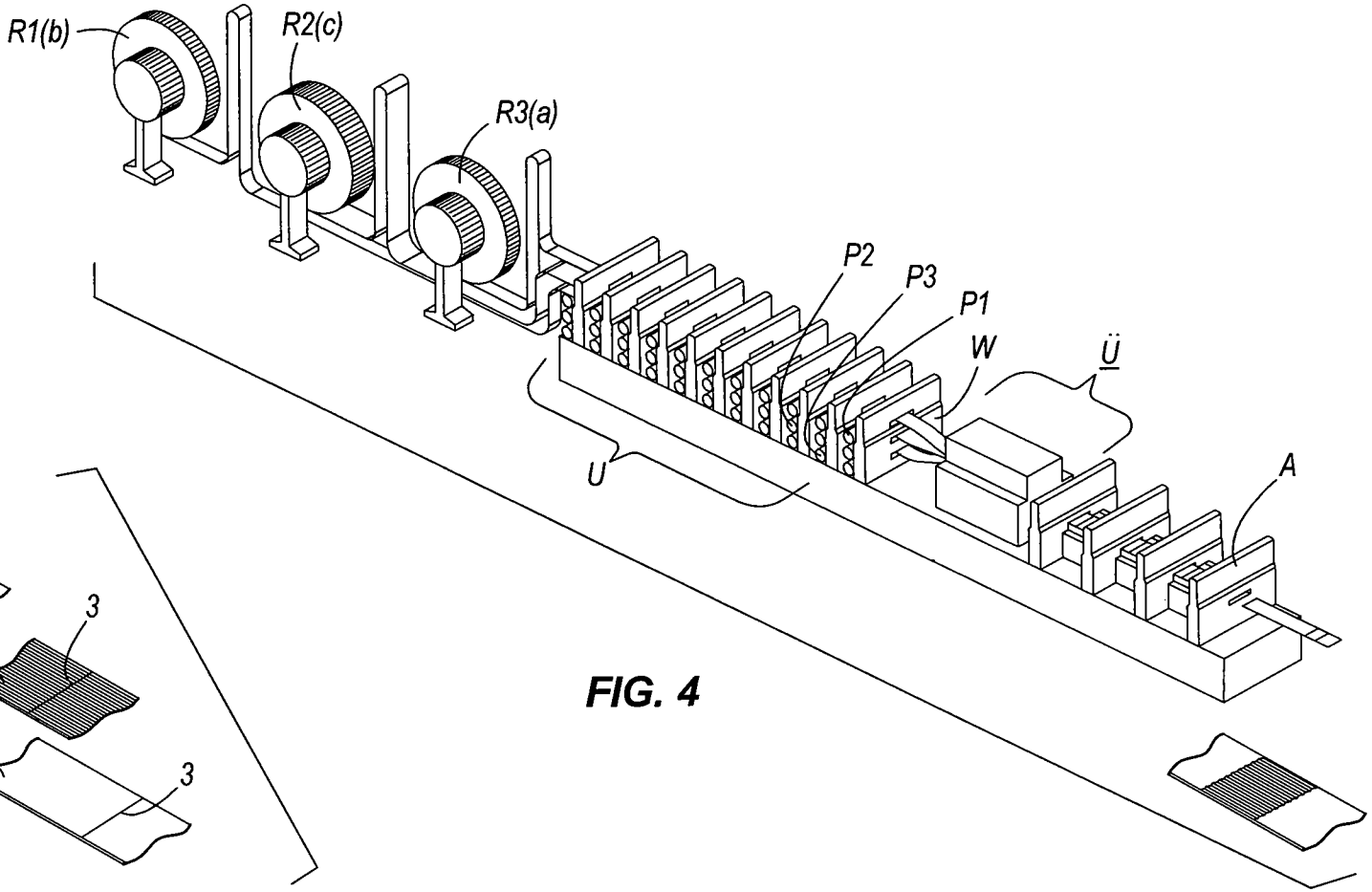
FIG. 4 shows a perspective view of a roller mill.

Because, as stated above, the preferred exemplary embodiment refers to three-part tubes, it is clear in FIGS. 1 and 4 that three roller ribbons R1, R2, R3 are present as the starting material. This material is sheet aluminum. The roller ribbon R1 produces the part a, the roller ribbon R2 produces the part c, the corrugated internal insert, and finally the roller ribbon R3 gives rise to the part b of the flat tube 1. As is shown in the illustration, in each case an extremely large loop is present in the ribbons just downstream of the roller ribbons R1, R2, R3, and said loops can be used to compensate different speeds or else stoppages of the ribbons. Depending on requirements it is also possible to provide a plurality of loops, which is also certain in the case in practice. The perforation stations P1, P2, P3 are located at the end of the shaping station U. Instead of perforations 3 it is also possible, for example, to provide ribbon thinning lines 3*b* as the predetermined break points (see FIGS. 3*b* and 3*c*).

Figure 6:
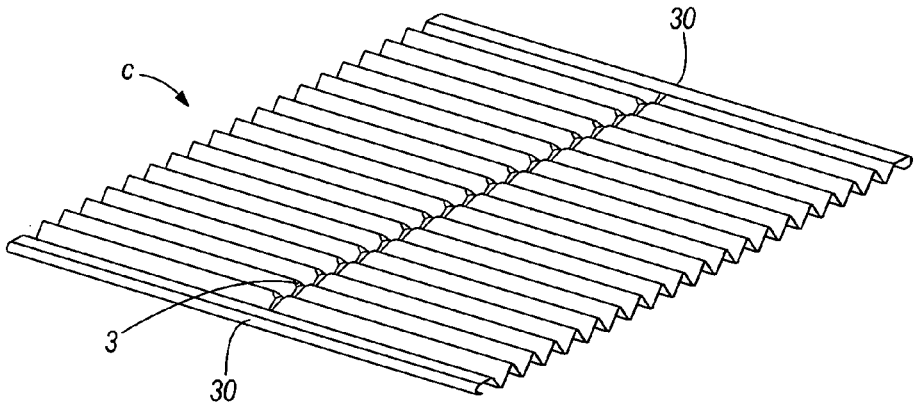
FIG. 6 is an enlarged view of a part of a flat tube during its manufacture.

In this exemplary embodiment on the first section of the shaping station U the roller ribbons R1 (part a) and R3 (part b) simply also run along without being already significantly shaped there. The upper roller ribbon R1 then reaches the perforation station P2. Just after this there is the perforation station P3 through which the lower roller ribbon R3 runs in order to be perforated. The edge shaping is then constructed on the parts a and b, and the part c is threaded in between the parts a and b, which cannot be seen in detail. However, a reference can be made in this regard to the older patent application DE 10-2006-029 378.9. In the case of doubt, the entire content of said document should be considered as being disclosed at this point and is hereby incorporated herein by reference. The perforation station P1 for the part c, the corrugated internal insert, lies at the end of the shaping station U. There, the perforations 3 are made in the already finally shaped corrugated internal insert c. Because in the exemplary embodiment shown the formation of the perforations 3 by means of the pair P of rollers leads to flattening of the corrugations in the area near to the perforations 3, a pair W of rollers is located downstream of the perforation station P1 and is used to manufacture again the corrugated shape in the nearby area. This is represented in FIG. 6, said figure showing the state after the perforation cutting has been carried out and before the corrugated internal insert c enters the pair W of rollers. It could also be advantageous to equip at least the pair W of rollers with a drive (not shown in the basic illustrations).

Approximately in the section Ü, the perforations 3 in the three parts a, b, c are made to correspond, for which purpose known open-loop and closed-loop control means (not shown) are used. This section Ü should, as a person skilled in the art certainly knows, be located upstream of the area in which the parts a, b, c are already connected to one another or are in secure physical contact because an individual speed adaptation could be necessary in order to make the perforations 3 correspond.

Figure 4A:
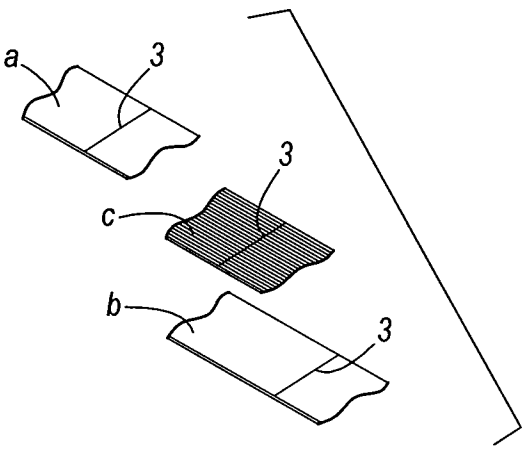

In the illustration in FIG. 4*a*, the three parts a, b, c have been indicated in a situation such as occurs approximately between the pair W of rollers and the station Ü. At said location the parts already have the perforations 3 which, as described, have to be made to correspond. If the parts a, b, c have subsequently been joined to form the tube 1, an endless tube 1 is then obtained and the individual tubes 1 are then to be separated off from it. In this exemplary embodiment subsequent to the section Ü there is a further shaping section U in which the parts a and b have been shaped at the longitudinal edges and joined to the third part c to form the tube.

Figure 5:
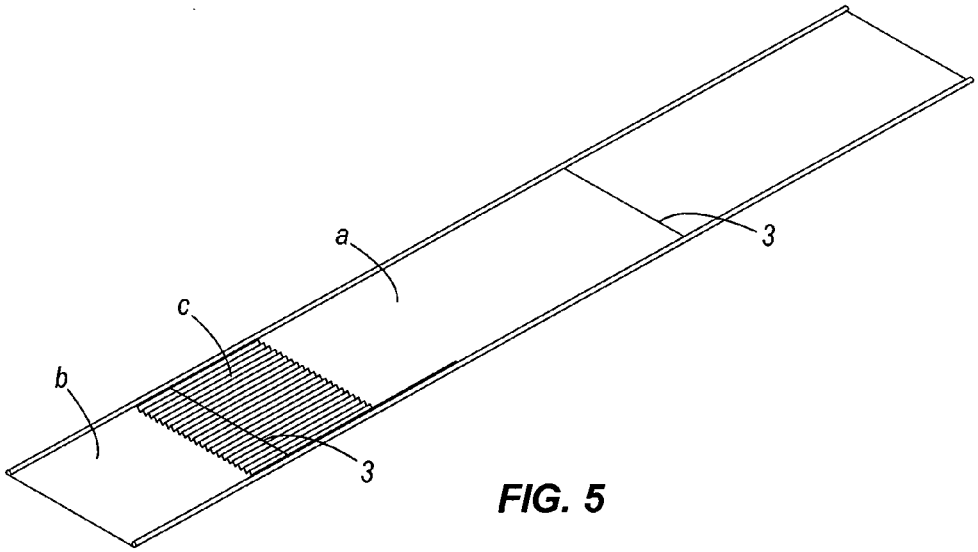
FIG. 5 shows a flat tube being manufactured on a roller mill in accordance with some embodiments of the method of the present invention.
Figure 7:
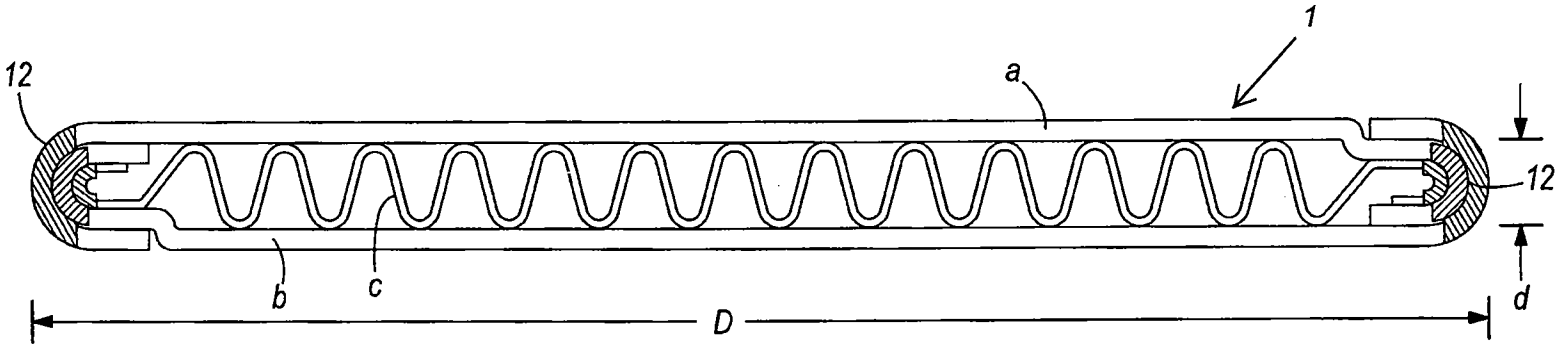
FIGS. 7 and 8 show cross-sectional views of a flat heat exchanger tube according to some embodiments of the present invention.
Figure 8:
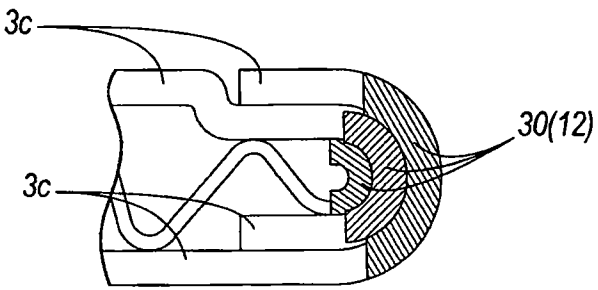

In FIG. 5 the state of the endless tube is shown in this situation. The upper wall part a has been broken off at the end in order to be able to show a piece of the corrugated internal insert c. In first trial series, the manufacturing method has been used to produce flat tubes whose large diameter D is approximately 55 mm (FIG. 7). Accordingly, the width of the sheet metal ribbon for manufacturing the wall parts a and b respectively is approximately 59 mm. The width of the sheet metal ribbon of the part c is significantly larger, perhaps 70-80 mm, which can be clearly seen in FIG. 4. With these dimensions it has become apparent that in each case only one web 30 is sufficient, for example at the two longitudinal edges of the sheet metal strips a, b. Intermediate webs 30 are therefore not necessary there.

Figure 2:
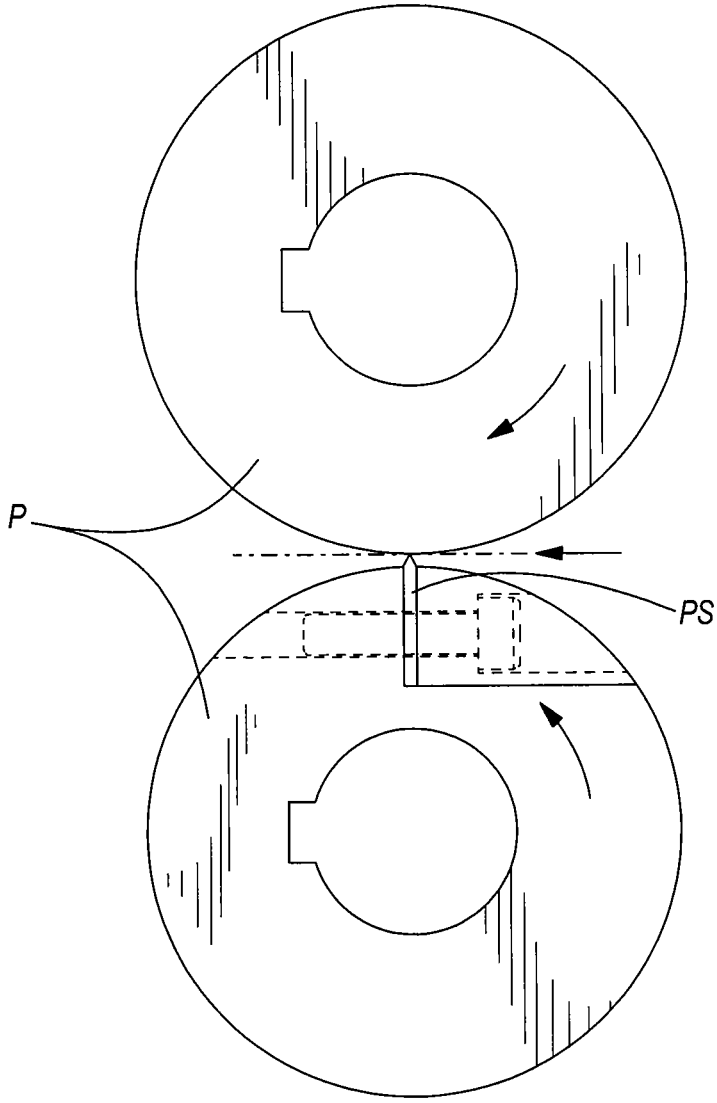
FIG. 2 is an enlarged view of a perforation station which can be located in the roller mill shown in FIG. 1.

With respect to the webs 30 it has proven particularly advantageous for them not to be constructed as far as the outermost longitudinal edge of the sheet metal ribbons a, b, c. It is better to form a slot 3*c* which is perhaps 2 mm long and is adjoined by the web 30 which itself could for example have a length of 2 to 8 mm depending on the dimension of the tubes, and after this the long slot 3*c* which extends as far as the web 30 which is also constructed on the other longitudinal edge of the sheet metal strip a and b respectively (see FIG. 3*b*, left-hand side). Furthermore, it may also be advantageous to reduce the thickness of the sheet metal in the vicinity of the webs 30 somewhat, as a result of which the later separation is made easier (not shown clearly). The above situation has been indicated in FIGS. 6 and 7 by hatching on the narrow sides 12 of the flat tube 1. The hatching shows in practice the webs 30 on which individual flat tubes 1 are still firstly connected to one another and are to be separated off later. The separation occurs at the separating station A (FIGS. 1 and 4). Furthermore, the third sheet metal strip c also has a configuration which is similar in terms of the construction of the webs 30 and slots 3*c*, and this has also been indicated in FIGS. 7 and 8. The three perforation stations P1, P2 and P3 which have already been mentioned may in principle be identical in construction. The perforation stations P1, P2, P3 are composed in the exemplary embodiment of a pair PP of rollers. One (upper) roller P preferably runs along and conveys the part a, b or c which is transported between the rollers P. The other (lower) roller P is constructed with a protruding perforation dye PS. Using conventional open-loop and closed-loop control means, the other roller P with the perforation dye PS is held in a waiting position in which the perforation dye PS is not in engagement. In this position, the perforation dye PS is on the left in FIG. 2, in a horizontal position on the roller P. The aforementioned means then ensure that the roller P is suddenly moved at a high rotational speed in order to arrive at the action position which is also shown in FIG. 2 and in which the perforation dye PS is in engagement and the perforations 3 are manufactured. The rotational speed or the circumferential speed of the rollers P is preferably higher than the transportation speed of the ribbon in order to ensure that the ribbon does not curl up. It must be remembered that the inventors have envisaged a ribbon speed of 100 to 200 m/min.

The perforations 3 are not cutouts, as FIG. 3 may be presumed to indicate, but merely quite fine indents which have webs 30 which are arranged at intervals and which are separated off later, as is customary per se with perforations in other fields. In particular, the significantly enlarged illustration in FIG. 3*b* serves merely to allow the webs 30 to be seen.

In order to carry out the separating process for the individual tubes 1, identical open-loop and closed-loop control means to those at the perforation stations P can be used.

Various features and advantages of the invention are set forth in the following claims.

What is claimed is:

1. A method of manufacturing heat exchanger tubes, the method comprising the acts of:

subjecting at least two endless ribbons to a shaping process on a roller mill;

perforating or forming predetermined break portions on at least one of the ribbons at a predetermined location before the at least two ribbons are combined to form a tube; and separating individual tubes from the tube after the tube is formed;

wherein the perforations or predetermined break portions are formed during or subsequent to the shaping process of the at least one of the ribbons.

2. The method of claim 1, wherein the shaping of the ribbons is performed again in an area near to the perforation or the predetermined break portions after the perforation or the predetermined break portions is formed.

3. The method of claim 1, wherein one of the at least two ribbons in which the perforations or the break portions are formed after the shaping is a corrugated internal insert of the flat tube.

4. The method of claim 1, wherein the perforations are either at least one slot with two webs or can be linear ribbon thinning lines which constitute the predetermined break points.

5. The method of claim 4, wherein the webs are constructed on two longitudinal edges of a corrugated internal insert.

6. The method of claim 4, wherein further webs can be constructed depending on a width of a corrugated internal insert or of the ribbons.

7. The method of claim 1, wherein a third ribbon is provided which constitutes the corrugated internal insert of the tubes, wherein the third ribbon is perforated after the construction of the corrugations, in that the perforations of the third ribbon are also made to correspond to the perforations of the two ribbons, and that the three ribbons are joined to form the tube.

8. The method of claim 1, wherein the separating is performed by one of breaking, cutting, and tearing.

9. The method of claim 1, wherein the perforation or the breaking of the ribbons is performed by rollers.

10. The method of claim 1, wherein the shaping process includes shaping a longitudinal edge of the at least one ribbon to at least partially form a narrow side of the tube.

* * * * *